United States Patent [19]

Kaulfuss

[11] 4,398,706

[45] Aug. 16, 1983

[54] WORK-HOLDING CLAMP WITH PIVOTABLE AND SLIDEABLE CLAMPING SCREWS

[76] Inventor: Herbert E. Kaulfuss, 3903 Barrington Dr. #1901, San Antonio, Tex. 78217

[21] Appl. No.: 354,889

[22] Filed: Mar. 4, 1982

[51] Int. Cl.[3] ..... B25B 1/20

[52] U.S. Cl. ..... 269/88; 269/156; 269/164; 29/261

[58] Field of Search ..... 269/156, 249, 287, 152, 269/155, 121, 258, 169, 266, 88; 29/258, 256, 261, 264, 257

[56] References Cited

U.S. PATENT DOCUMENTS

| | | | |
|---|---|---|---|
| 242,959 | 6/1881 | Naglee . | |
| 339,072 | 3/1886 | Nies | 269/249 |
| 1,123,513 | 1/1915 | Gaillard | 29/261 |
| 1,608,320 | 11/1926 | Karseboom | 269/88 |
| 2,366,350 | 1/1945 | Ostling . | |
| 2,576,904 | 11/1951 | Jessen et al. | 269/249 |
| 2,610,661 | 9/1952 | Romine . | |
| 2,642,905 | 6/1953 | Hewat . | |
| 2,821,777 | 2/1958 | Keister | 29/259 |
| 3,060,579 | 10/1962 | Sharp . | |
| 3,952,936 | 4/1976 | Dearman | 228/49 B |
| 4,011,648 | 3/1977 | Martinson et al. | 29/264 |
| 4,201,376 | 5/1980 | Philips . | |
| 4,234,176 | 11/1980 | Goff et al. . | |

*Primary Examiner*—Robert C. Watson

*Attorney, Agent, or Firm*—Nicholas A. Kees

[57] ABSTRACT

A light to moderate duty work-holding clamp which also can be used as a gear or wheel puller. The body of the clamp is formed of two C-shaped plates, aligned and spaced apart by 2 blocks, one attached to each end of the C-shape. A large clamping screw is threaded through each block. The blocks are mounted to the plates in a pivotable manner, so that the two clamping screws can be pivoted through 360 degrees freely. One end of each of these two clamping screws has a bearing face for bearing the pressure to be applied by the screws. These bearing faces can be snapped on and off the ends of the screws. The other end of each of these two screws terminates in a hook-shaped portion, which can provide the gear pulling function if used in combination with a third clamping screw. This third clamping screw is threaded through a third block which is attached slidably between the C-shaped plates. This block can slide to any point along the C-shape between the first two blocks, turning as it moves along. The third clamping screw thus also changes its angle as the block is slid. One end of the third screw again ends in a snap-removable bearing face, while at the other end is an enlarged knurled knob to aid in turning the screw. This third block has a set screw so that it can be secured anywhere along the C-shape. The first two blocks can be locked in either a horizontal position or a vertical position by means of pins inserted through holes in the plates and aligned holes in the blocks.

7 Claims, 3 Drawing Figures

WORK-HOLDING CLAMP WITH PIVOTABLE AND SLIDEABLE CLAMPING SCREWS

BACKGROUND OF THE INVENTION

This invention relates to the field of work-holding clamps, and in particular to those work-holding clamps applying pressure all in one plane for light to moderate duty applications.

Earlier clamps in this field, while well-suited for the purposes for which they were intended, have been very limited as to their scope and range of use. For instance, Naglee, U.S. Pat. No. 242,959, issued June 14, 1881, probably represents one of the original edge clamp patents. All threaded members shown are rigidly attached, and the uses to which the clamps can be put is thus limited to holding an edge portion against a main portion until the glue holding the two pieces together dries.

In Ostling, U.S. Pat. No. 2,366,350, issued Jan. 2, 1945, the arms holding the screws are allowed to move relative to each other, but each screw is still rigid with respect to the arm holding it. This again limits the usefulness of the clamp to holding a T-joint in a glue-drying function.

Finally, in Hewat, U.S. Pat. No. 2,642,905, issued June 23, 1953, one of the screws is allowed to move and pivot with respect to its bracket. This allows it to be used as an edge clamp on more irregular surfaces, although it is essentially limited to that function.

This invention relates to improvements over the above clamps and to solutions to some of the problems raised by their limitations.

SUMMARY OF THE INVENTION

This invention includes two C-shaped plates bolted together and separated at their ends by blocks. Large screws are then threaded through the blocks, so that the screws are swingable with respect to the plates. Each of these screws has a hook-shaped portion on one end and a swivelable bearing face on the other end. A third block is also placed between the C-plates, and slidably held there by fastening plates. A third large screw is threaded through this block. This third screw is equipped with a swivelable bearing face on the end towards the mouth, while the other end terminates in a knurled knob for turning the screw.

An object of this invention is to provide an improved work-holding clamp having two clamping screws which are swingable with respect to the clamp body.

Another object of the invention is to provide an improved work-holding clamp also having a third clamping screw which is slideable along the body of the clamp.

A more specific object of the invention is to provide a work-holding clamp in which the two swingable screws have a hook-shaped portion on one end and a bearing face on the other end, so that the clamp can be used as a gear puller or as an edge clamp.

Another specific object of the invention is to provide an improved work-holding clamp in which the two swingable screws are lockable in certain positions for use as a C-clamp, a vise, or a variable edge-clamp.

Other objects and advantages of the invention will appear hereinafter.

DESCRIPTION OF THE PREFERRED EMBODIMENT

Figure 1:
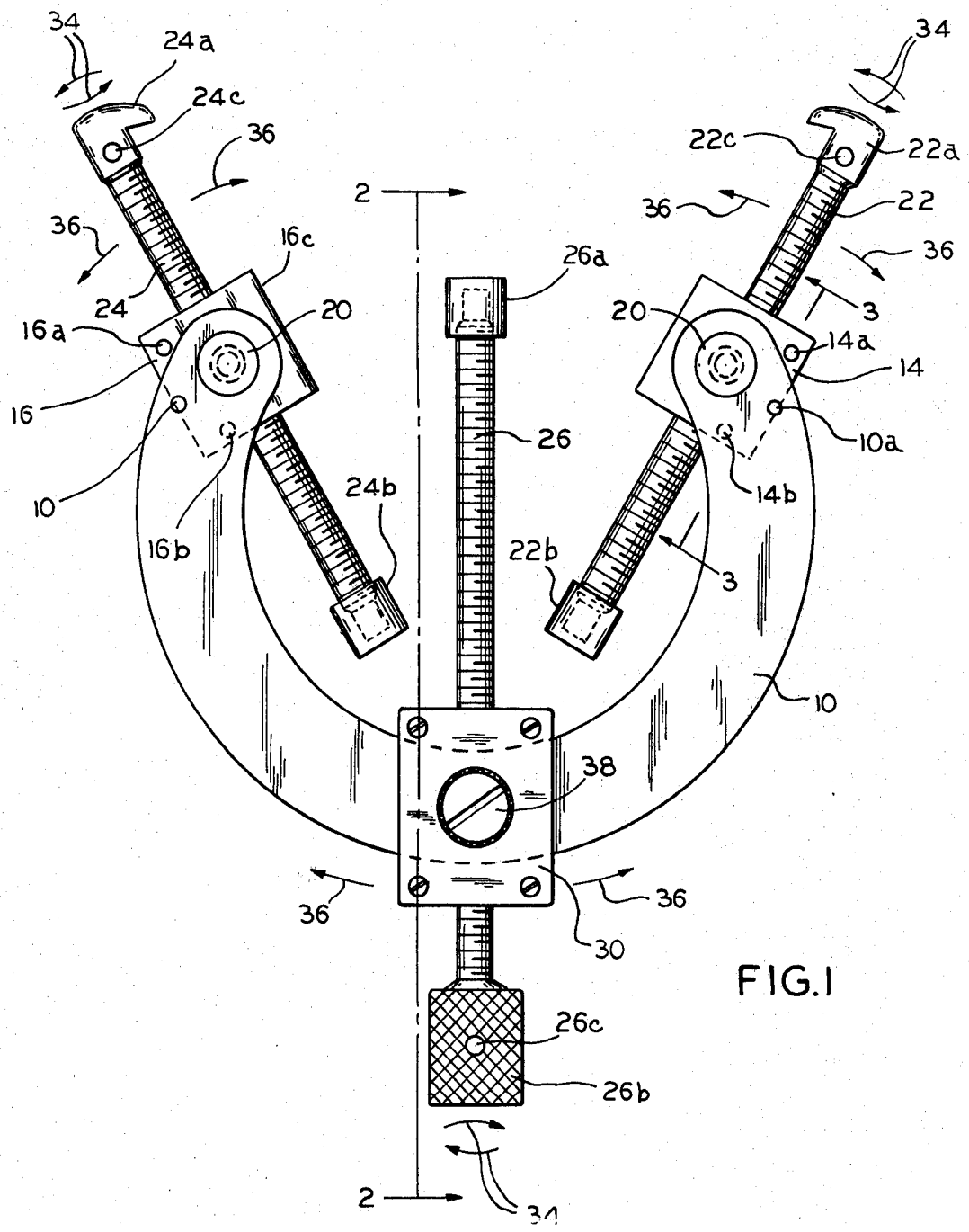
FIG. 1 is a plan view, in elevation, of the invention.
Figure 3:
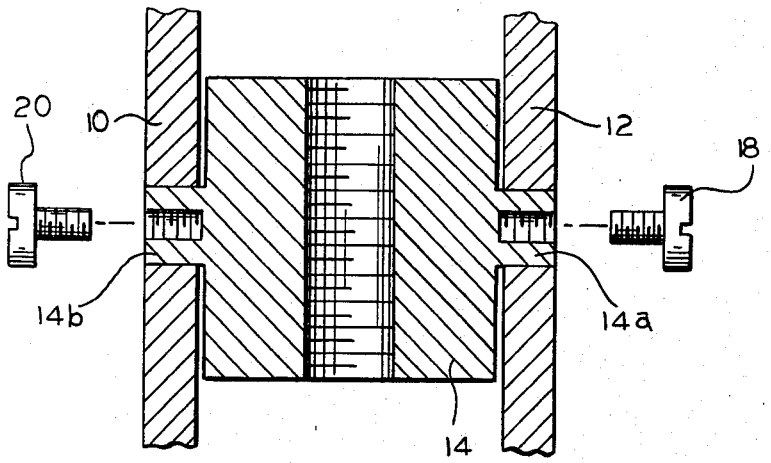
FIG. 3 is a fragmentary sectional view taken along line 3—3 of FIG. 1.
Figure 2:
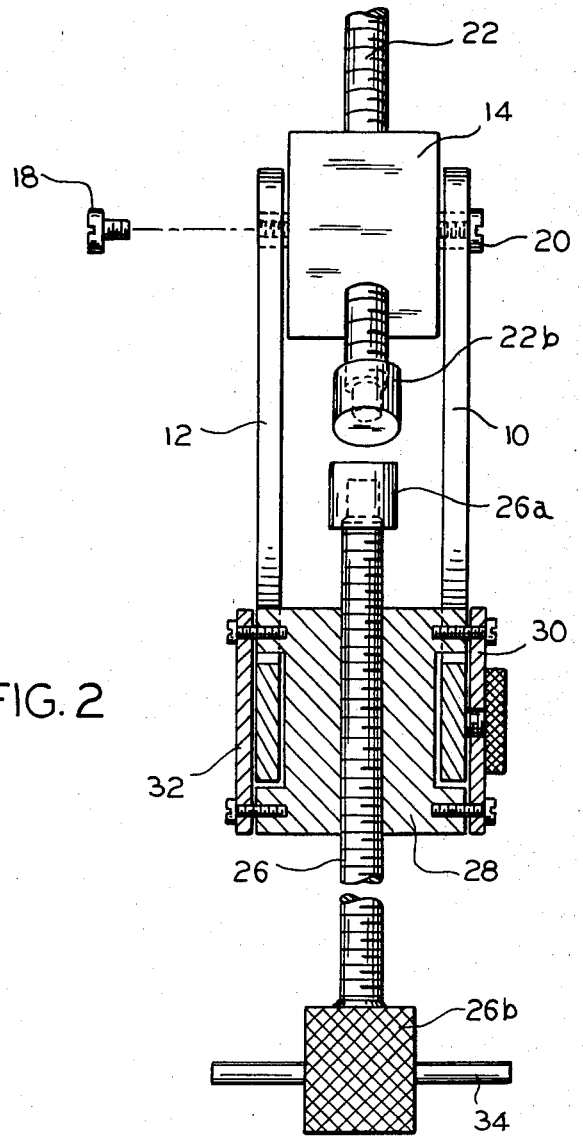
FIG. 2 is a cross-sectional view taken along line 2—2 of FIG. 1.

Referring to FIGS. 1 and 2, the invention includes two C-shaped metal plates 10 and 12, pivotably connected at their ends to metal blocks 14 and 16. Block 14 is attached between plates 10 and 12 as shown in FIG. 3, and block 16 is attached similarly. Perpendicular projections **14*a* and 14*b* of block 14 fit closely into apertures in the plates 10 and 12. The height of the projections is approximately equal to or slightly greater than the thickness of the plates. There is a hole in the center of each projection, the depth of which is approximately equal to the height of the projection. The holes are tapped, and threaded fasteners 18 and 20** are inserted to hold the plates to the block. The threaded fasteners must be short enough that the heads are stopped against the tops of the projections, or very near the tops if the fasteners are allowed to bottom in the holes. Thus the plates are loose enough to be turnable with respect to the block, with the bearing surfaces being the outside surfaces of the projections themselves.

A larger hole, the longitudinal axis of which is parallel to the planes of plates 10 and 12, reaches through blocks 14 and 16, and is also tapped. Large screws 22 and 24 are then threaded into these holes in blocks 14 and 16 respectively. One end of each of these screws has a hook-shaped portion **22*a* and 24*a* respectively, which is integral with the respective end of the screw. The opposite end terminates in a bearing face 22*b* and 24*b* respectively, which is removably attached to the screw after threading through the respective block 14 or 16**. The method of attachment of these bearing faces is preferably via a snap means, so that they can be removed when desired and so that they will not be removed inadvertently.

A third large screw 26 is then slidably attached between the two C-shaped plates by threading it through a third block 28, shown in FIG. 2. This block 28 has channels cut in it, one on each outer face. The depth and width of these channels is somewhat greater than the depth and width of the C-shaped plates. Cover plates 30 and 32 are then secured over these channels in order to hold block 28 between the C-shaped plates. Threaded fasteners are the preferred means of attachment of these plates to facilitate replacement of parts. A bearing face **26*a* is again snapped onto the end of screw 26 which points toward the center of the C-shape of the plates. At the other end, screw 26 terminates in an enlarged knurled knob 26*b* for easier turning. To further increase leverage in turning screw 26, a small rod 34 can be inserted into aperture 26*c* of knurled knob 26*b*. For that matter, this rod can also be inserted into similar apertures 22*c* and 24*c* in the hook-shaped portions 22*a* and 24*a* of the other two large screws 22 and 24**, again for increasing the leverage in turning the screws.

As previously stated, the channels in block 28 are somewhat larger than C-shaped plates 10 and 12. The purpose of this is to allow block 28, and consequently screw 26, to slide along the C-shape of plates 10 and 12, thus changing the angle and location of screw 26 with respect to the C-shaped plates. Thus all three screws are not only turnable, as indicated by arrows 34 in FIG. 1, but they also have the capacity to change their angle with respect to C-shaped plates 10 and 12, as indicated by arrows 36 in FIG. 1.

This movement, however, must be prevented when pressure is being applied by the screws to a workpiece. The screws must be locked in place to allow sufficient pressure to be exerted. Hence, a set screw 38 is threaded through cover plate 30 and contacts C-shaped plate 10 to lock the position of block 28 when screw 26 is being used. Both blocks 14 and 16 holding screws 22 and 24 can be locked in any one of several positions, preferably two, unlike block 28 which is infinitely variable over its range. While the invention is not to be construed as limited to this, the embodiment disclosed below refers to only two positions (horizontal and vertical) to facilitate understanding.

Block 14 holding screw 22 is locked in place by inserting pin means, such as a cotter pin (not shown), into an aperture 10*a* in plate 10, shown in FIG. 1, through block 14 via hole 14*a* or hole 14*b*, depending upon the position desired for screw 22, and out a matching hole in plate 12 (not shown). Correspondingly, the position of screw 24 is locked by use of hole 10*b* (and a matching hole in plate 12, not shown) and either hole 16*a* or 16*b* of block 16, again depending upon the position desired. Use of holes 14*a* and 16*a* will result in horizontal screws, and use of holes 14*b* and 16*b* will result in vertical screws, as viewed in FIG. 1. Moreover, any combination of horizontal and vertical can be used, so that for example if screw 22 were held horizontal and screw 24 vertical, screw 22 could force a workpiece against the flat face 16*c* of block 16, and so on. The user is thus provided with a versatile tool which can be used variously as a deepthroated C-clamp, an edge clamp, and other uses, and as a gear or wheel puller when screws 22 and 24 are not locked in place as described above.

While the apparatus hereinbefore described is effectively adapted to fulfill the aforesaid objects, it is to be understood that the invention is not intended to be confined to the particular preferred embodiment of work-holding clamp herein set forth, inasmuch as it is susceptible of various modifications without departing from the scope of the appended claims.

What is claimed is:

1. A clamp comprising:

two C-shaped plates, aligned and arranged in planes parallel to each other;

support means for assuring uniform separation between said plates throughout their length;

two screws for applying clamping pressure, each of which is pivotably attached to said two plates, one screw at each end of the C-shape of said plates; and a third screw for applying clamping pressure slidably attached between said two plates, slidable to an infinite number of points between the ends of the C-shape of said plates, and lockable at each of those points by means of a set screw, between the ends of the C-shape of said plates, such that as its means of attachment is slid around the C-shape, the angle of said third screw with respect to said plates changes.

2. A clamp as recited in claim 1 wherein said support means includes two blocks, pivotably attached between said two plates, one attached at each end of the C-shape, and wherein each of said two clamping screws are threaded through said blocks, such that when said blocks pivot about their point of attachment said screws also pivot about the same point.

3. A clamp as recited in claim 2 wherein said support means further comprises a third block slidably attached between said plates and between said other two blocks, and wherein said third clamping screw is threaded through said third block, such that as said third block slides along the C-shape of said plates, the angle of said third screw with respect to said plates changes.

4. A clamp as recited in claim 3 wherein the opposite end of said first two clamping screws terminates in a hook-shaped portion, and the opposite end of said third clamping screw terminates in an enlarged knob, such that said clamp can also be employed as a gear puller.

5. A clamp as recited in claim 4 further comprising means for locking each of said first two clamping screws in at least one particular position, allowing greater pressure to be exerted by said screws.

6. A clamp comprising:

two C-shaped plates, aligned and arranged in planes parallel to each other;

support means for assuring uniform separation between said plates throughout their length;

two screws for applying clamping pressure, each of which is pivotably attached to said two plates, one screw at each end of the C-shape of said plates; and a third screw for applying clamping pressure, which is slidably attached to said two plates, between the ends of the C-shape of said plates;

removable bearing faces, one attached to one end of each of said first two clamping screws and one to the end of said third clamping screw pointing toward the center of the C-shape, which bearing faces, when removed, allow removal of the corresponding clamping screw for replacement;

said support means including two blocks pivotably attached between said two plates, one attached at each end of the C-shape, each of said first two clamping screws being threaded through said blocks such that when said blocks pivot about their point of attachment said screws also pivot about the same point, and a third block slidably attached between said two plates and between said first two blocks, said third clamping screw being threaded through said third block such that as said third block slides along the C-shape of said plates, the angle of said third screw with respect to said plates changes;

and wherein the opposite end of each of said first two clamping screws terminates in a hook-shaped portion, and the opposite end of said third clamping screw terminates in an enlarged knob, such that said clamp can also be employed as a gear puller.

7. A clamp as recited in claim 6 further comprising means for locking each of said three clamping screws in at least one particular position, allowing greater pressure to be exerted by said screws.

* * * * *